United States Patent [19]

Nemit et al.

[11] 4,243,990

[45] Jan. 6, 1981

[54] INTEGRATED MULTIBAND ARRAY ANTENNA

[75] Inventors: Jeffrey T. Nemit, Canoga Park; George A. Hockham, Valencia; Ronald I. Wolfson, Northridge, all of Calif.

[73] Assignee: International Telephone and Telegraph Corporation, New York, N.Y.

[21] Appl. No.: 34,548

[22] Filed: Apr. 30, 1979

[51] Int. Cl.[3] ..... H01Q 13/10

[52] U.S. Cl. ..... 343/771; 343/770

[58] Field of Search ..... 343/770, 771, 700 MS, 343/846, 806

[56] References Cited

U.S. PATENT DOCUMENTS

| | | | |
|---|---|---|---|
| 3,377,592 | 4/1968 | Robieux et al. | 343/700 MS |
| 3,523,297 | 8/1970 | Fee | 343/771 |
| 3,740,751 | 6/1973 | Nemit | 343/771 |
| 3,963,999 | 6/1976 | Nakajima et al. | 343/771 |

*Primary Examiner*—David K. Moore

*Attorney, Agent, or Firm*—William T. O'Neil

[57] ABSTRACT

An integrated planar antenna array comprising at least two separate interleaved arrays separately controllable and responding to separate frequency bands. Both arrays operate with substantially the same phase center and substantially within the same effective aperture. The first array or subarray comprises spaced linear, slotted-waveguide arrays and the second subarray includes a meander line occupying the space between each of the waveguides of the first array. Scan systems are shown for independent operation of the two arrays. An alternative for the second subarray is shown in the form of slotted, square-coaxial, linear arrays in the spaces between the waveguides of the first subarray.

5 Claims, 13 Drawing Figures

PERIOD L = 9.2ins
TROUGH WIDTH(g) = 0.86ins
$l_y$ = 2.6ins

PERIOD L = 9.2ins
g = 0.86ins
$l_y$ = 2.6ins

L = 9.2ins
g = 0.86ins
$l_y$ = 2.6ins

INTEGRATED MULTIBAND ARRAY ANTENNA

BACKGROUND OF THE INVENTION

1. Field of the Invention

The invention relates to antenna technology generally and, more particularly, to directive phased arrays.

2. Description of the Prior Art

In the prior art, slotted waveguide antennas have been used and extensively described in the technical and patent literature. In the text, "Radar Handbook" by Merrill I. Skolnik (McGraw Hill 1970), for example, a planar array formed of a plurality of slotted waveguide linear subarrays is shown and discussed in Chapter 13, dealing with frequency-scanned arrays. U.S. Pat. No. 3,740,751 discloses a slotted-waveguide array with dual slots for improved bandwidth and greater scanning angle capability. Other references are also available, and accordingly, the performance of such arrays is relatively well known.

The meander line antenna is also known per se. Where such a line, drawing basically from microwave stripline technology, is placed between conductive planes, it is sometimes referred to as a "Sandwich Wire Antenna." In 1957, such an antenna was described by W. Rotman and N. Karas in "The Sandwich Wire Antenna: a New Type of Microwave Line Source Radiator," appearing in the IRE Nat. Conference Record 1957, Pt. 1, pp. 162–172. Those authors further described such devices in an article entitled "The Sandwich Wire Antenna," (Microwave Journal, Vol. 2, August 1959. A still more recent reference appeared in the IEEE Trans. Antenna and Propogation, Vol. AP-19 No. 5, September 1971, under the title "A New Analysis of the Sandwich Wire Antenna."

In operating arrays adjacently at different frequencies there are a number of interference and blockage problems which can be identified. These are particularly evident on shipboard where more than one view of the environment is desirable. The problems are particularly significant where target tracking (for example) is to be handed over from a system operating at a second frequency,. Prior art arrangements of the type have also suffered from the displacement of antenna phase centers from one array to another.

The manner in which the invention improves upon the prior art to provide integration of essentially two scannable arrays operating in different frequency bands into one overall antenna aperture will be evident as this description proceeds.

SUMMARY

The invention includes two subarrays, the first being formed by a plurality of dual-edge-slotted linear arrays in halfheight waveguide. The slotted waveguides are spaced in height (the dimension normal to the waveguide array length) to form intervening troughs into each of which a linear meander line is placed. The waveguide linear arrays are fed in accordance with known techniques in view of scanning requirements to form a first subarray. The meander lines are appropriately fed independently of the waveguides to form a second subarray. Typical operating bands are "S" band for the first subarray and "L" band for the second subarray. The details of a typical implementation are presented in the description to follow.

It will be realized that blockages are effectively eliminated, and a common phase-center for the two arrays is achieved. Moreoever, total mechanical support structure is obviously less than required for two independently mounted arrays

BRIEF DESCRIPTION OF THE DRAWINGS

FIG. 1(*a*) is a typical serpentine type waveguide feed for the slotted-waveguide portions of the array of FIG. 1.

DETAILED DESCRIPTION

Figure 1:
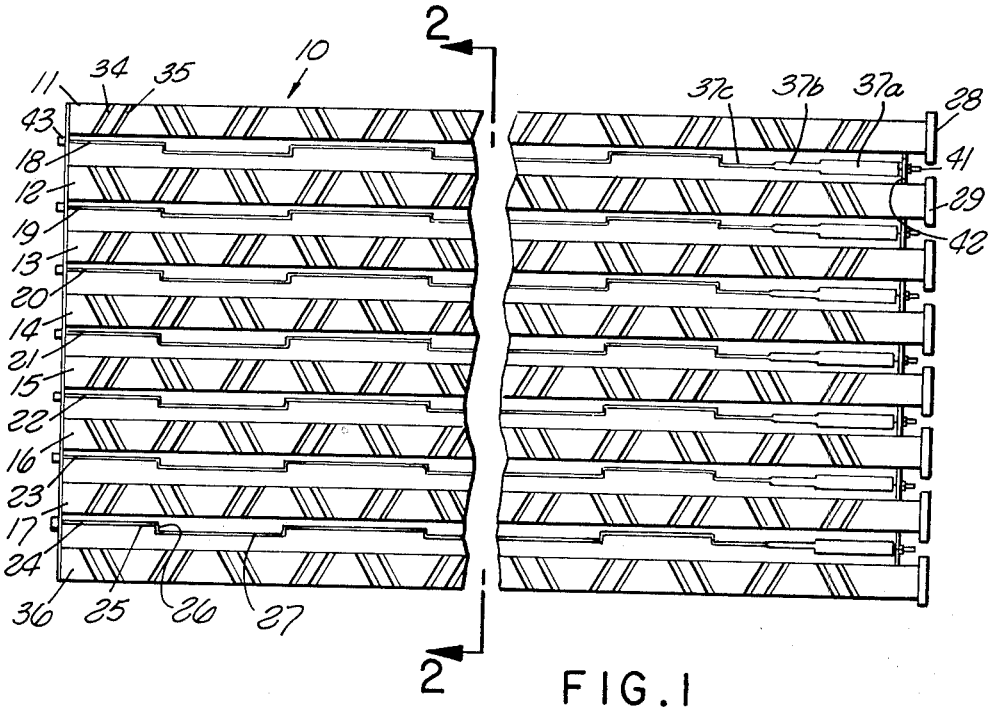
FIG. 1 is a pictorial view of an integrated array of slotted-waveguide and meander line elements according to the invention.
Figure 1A:
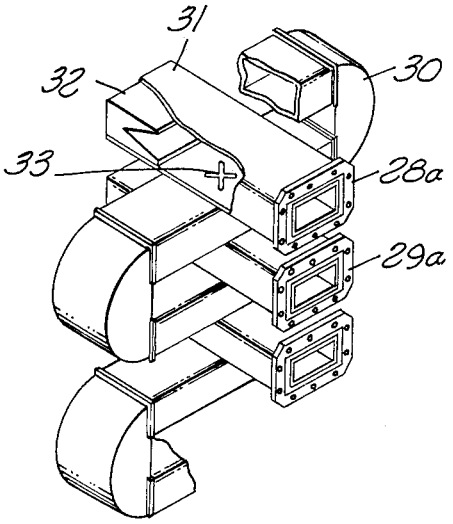

Referring now to FIG. 1, a pictorial view of an integral array according to the invention in its preferred form is shown. A plurality of individual linear, slotted-waveguide arrays 11, 12 13, 14, 15, 16, 17 and 36 are shown in a spaced relationship. Placed alternately and between these individual linear arrays is a second subarray comprising of a plurality of individual linear, meander line arrays identified in FIG. 1 as 18, 19, 20, 21, 22, 23 and 24. The plural slotted-waveguide arrays provide a planar first subarray and the intervening meander line arrays form a planar second subarray of these individual meander line arrays. The slotted-waveguide elements are appropriately fed by means depicted in FIG. 1(*a*), and the second subarray of meander line elements is independently fed by means to be discussed hereinafter.

For convenience, if the integral array of FIG. 1 is assumed to extend vertically with the slotted-waveguide elements in an essentially horizontal plane, both subarrays may be regarded as capable of effecting both azimuth and elevation scanning independently. Each inherently produces a pencil beam, and each has its own discrete feed so that scanning may be effected independently. Actually, the configuration of FIG. 1 is adapted to the type of feed arrangement required for producing vertical (elevation) scan. Whatever azimuth scan might be desired or required can be effected by some other means such as mechanical rotation of the antennas as an assembly about a vertical axis.

Referring now to FIG. 1(*a*), a typical feed arrangement for the subarray comprising the slotted waveguides (i.e., 11, 12, 13, 14, 15, 16, 17, and 36 as illustrated in FIG. 1) is depicted. This type of feed is a so-called serpentine waveguide feed. Basically, it is a tapped transmission line, in which individual waveguide sections, such as 31 in FIG. 1(*a*), are tapped or coupled successfully from a main feed serpentine 30. The serpentine shape serves to elongate the path between successive taps (such as 33 associated with waveguide feed section 31), thereby to increase the amount of effective phase delay between successive taps such as 33. Such an arrangement is highly practical and effective and is well known in frequency scanning systems.

A typical termination in each coupled waveguide section is illustrated at 32 in connection with 31. Serpentine coupling flanges 28(*a*) and 29(*a*) will be understood to couple to the flanges 28 and 29 in FIG. 1, for example. Obviously, there are as many coupling flanges in the feed arrangement of FIG. 1(*a*) as there are individual slotted-waveguide, linear arrays in FIG. 1.

Figure 2:
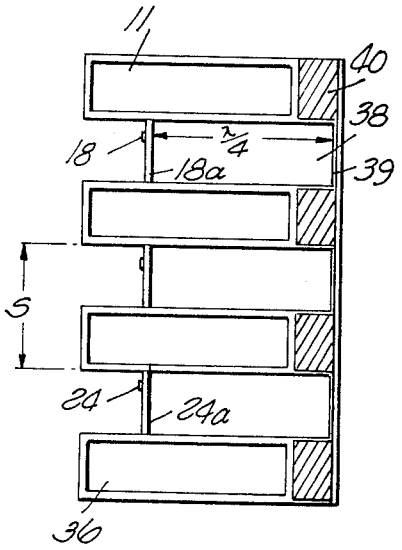
FIG. 2 is a partially-sectioned side view of the integrated array of FIG. 1.

Referring now to FIG. 2, a cut-away end (right side) view of the apparatus of FIG. 1 is shown. This cut-away may be assumed to have been taken as a sectional view through the center of the array assembly in FIG. 1. Fewer of the slotted waveguide and meander line, linear subarrays are depicted in FIG. 2 vis-a-vis FIG. 1, for simplicity. The top and bottom slotted waveguides 11 and 36, respectively, are shown, however, as well as the top and bottom meander lines 18 and 24, respectively.

It will be noted that each meander line is backed by the intervening space (trough) formed between two adjacent slottedwaveguide sections, and that this intervening space is essentially enclosed by conductive walls. For example, meander line 18 mounted on dielectric board 18*a* is backed by the intervening space 38 bounded by the extended broad walls of the adjacent slottedwaveguides and the conductive backplate 39. Spacers, typically 40, are mechanical only and, therefore, may be of metal, or of dielectric material so long as conductive material extends to the backplate 39 as shown in FIG. 2.

It will be noted that the typical meander line 18 is located a quarter wavelength (at midband) from the conductive backplate 39. As will be seen later, this configuration results in a planar meander line subarray of particularly broad band capability. In a particular utilization of the apparatus of FIG. 1, the slotted waveguide arrays were designed for "S-Band" operation and as such on the order of 0.83 inches by 3.00 inches outside dimensions (in cross-section), as illustrated in FIG. 2.

The dimensions relating to spacing of the waveguide arrays as illustrated in FIG. 2 were on the order of 1.7 inches in the particular embodiment described. The dimensions and other design considerations in respect to the meander lines themselves will be described hereinafter.

Figure 3:
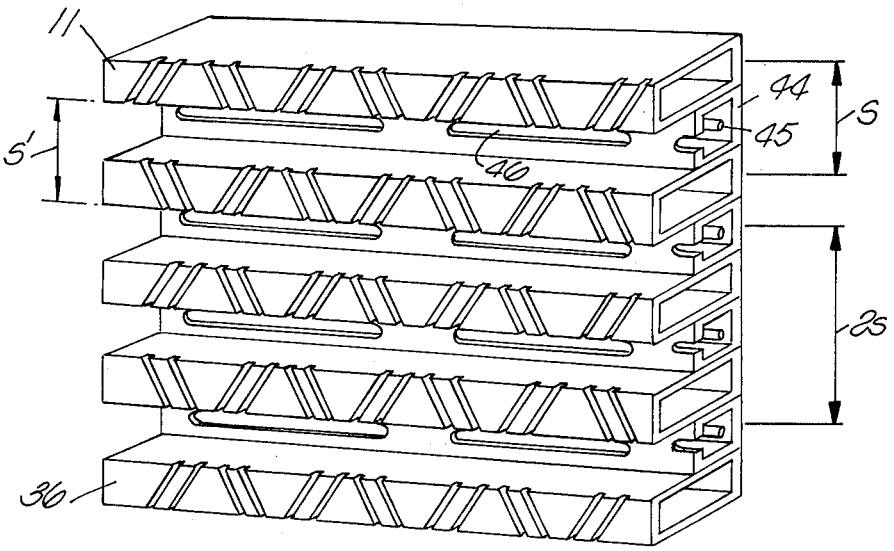
FIG. 3 is an alternative form of integrated multiband array according to the invention implying a plurality of linear, slotted-waveguide arrays for interleaved slotted-coaxial-line arrays forming the second of the two subarrays provided.

Referring now to FIG. 3, another embodiment in which the second subarray comprises a plurality of linear slotted-coaxial transmission lines of square cross-section is depicted. The S band slotted-waveguides are essentially the same as those described in FIG. 1, however, the coaxial line subarray is particularly useful where relatively narrow-band operation of the second subarray is desired or can be tolerated. In FIG. 3, slotted waveguide linear arrays 11 and 36 are repeated, but in lieu of the meander lines in the intervening (trough) spaces between adjacent slotted waveguides, a square, coaxial transmission line 44 with center conductor 45 and inclined horizontal slot typically 46 is provided. The second subarray comprising the plurality of slotted, square, coaxial lines according to FIG. 3 produces vertical polarization vis-a-vis the horizontal polarization provided by the slotted waveguide subarray. The square, coaxial subarray is inherently narrow-band as compared to the slotted-waveguide arrangement and particularly as compared to the meander line arrangement of FIG. 1, however, it is capable of higher power operation than is possible with the meander lines. In view of this fact, the second subarray of slotted, square, coaxial lines may actually comprise slots such as 46 of varying lengths in alternate square coaxial lines, as suggested in the showing of FIG. 3. Thus, operation from UHF through L-band is possible, or the L-band might be split into two parts, high and low, as accommodated by such a variable slot length arrangement.

For purposes of this description, the so-called L-band will be understood to be on the order of 1 to 2 GHz while the S-band, slotted-waveguide subarray would be intended to operate in 2 to 4 GHz range approximately. Of course, different frequency combinations are possible, i.e., the slotted waveguides might be made to operate in the X-band which is on the order of 8.2 to 12.4 GHz, in which case the slotted waveguide cross-sectional dimensions would be smaller. Accordingly, frequencies of operation are to be understood to be illustrative only. The spacing S' is to be understood to be essentially the same as S depicted in FIG. 2. Typical values for representative frequency design conditions will be referred to as this description proceeds.

Figure 4:
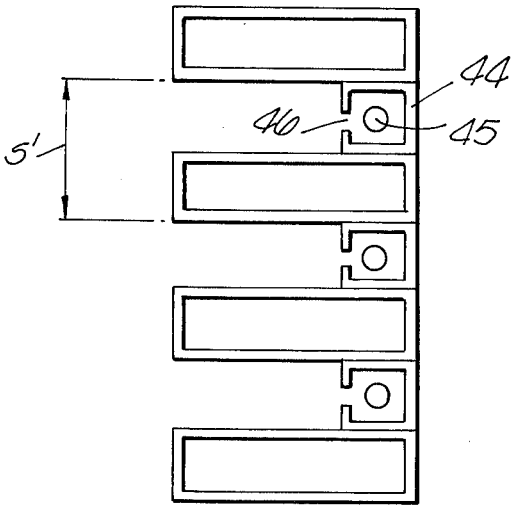
FIG. 4 is a partially-sectioned side view of the integral array of FIG. 3.

FIG. 4 is a right-end view of FIG. 3 for further clarity.

Figure 5A:
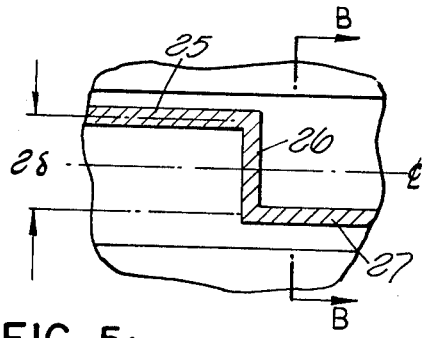
FIGS. 5A and 5B is a detail of a section of meander line as provided in the second subarray combination as depicted in FIGS. 1 and 2.

Referring again to the configuration of FIGS. 1 and 2, the second subarray comprising a plurality of meander lines will be further described with reference to FIGS. 5(*a*), 5(*b*) and 7.

In order to radiate from a "meander line", it is necessary to produce a component of current perpendicular to the trough. In FIG. 1 a typical one of the meander lines 24 is arbitrarily identified with discrete sections 25, 26 and 27, as illustrated. Parallel (longitudinal) sections 25 and 27 are joined by an abruptly offset or orthogonal section 26. From FIG. 5(*b*), this physical "modulation" of meander line has an offset between adjacent parallel sections such as 25 and 27 of (28) on either side of the horizontal centerline, as illustrated in FIGS. 5(*a*) and 5(*b*). It will be realized, however, that a trapezoidal or even sinusoidal meander line could be used, in lieu of the form illustrated in FIG. 1.

The quarter-wavelength trough depth from the typical printed circuit radiator 27 to the short-circuited end of the trough, amounts to approximately 2.6 inches, which is a quarter wave at 1125 MHz. Similarly, the dimensions f amount to 3.5 inches at that center frequency, this dimension f being measured from the trough shortcircuited end to the aperture plane of the slotted waveguides of the first subarray. Two of these slotted waveguides 17 and 36 are identified for reference in FIG. 5(*b*).

Figure 5B:
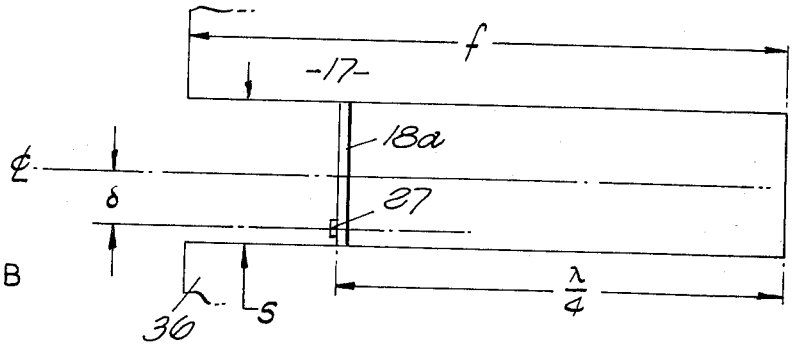
Figure 7:
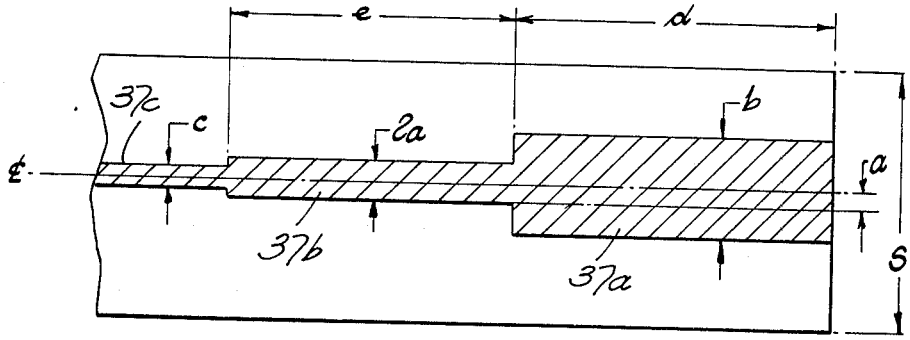
FIG. 7 is a detail of a stepped two-section, input matching transformer applicable to the meander line subarray portion of the apparatus of FIGS. 1 and 2.

The meander line, being typically a printed-circiut element, is deposited on a dielectric board shown at 18(*a*) in FIG. 5(b). A typical dielectric board material is the so-called "Duroid" material, preferably of about 1/16th of an inch thick. The width of the meander line itself, i.e., the width of 25, 26 and 27 of FIG. 5(*a*) (27 also being shown in FIG. 5(*b*) ) is shown in FIG. 7 as dimension c and is typically on the order of 50 thousandths of an inch. Dimension a, as illustrated in FIG. 7, is exactly ½ of the width of 37*b* so that the longitudinal centerline passes symmetrical about the center of the printed circuit matching transformer section illustrated in FIG. 7.

Referring back to FIG. 1, the outer conductor of the coaxial connector 41 is to be understood to be attached to the conductive end-wall 42, with the center conductor 41 connecting substantially on the centerline of 37a. The connector end of 37*a* is only minimally spaced from the conductive end-wall 42, resistance to arcing at that point being the determined feature. However, in practice the consequences of such an impedance discontinuity are trivial. Similarly, a small clearance at the extreme end of each meander line is provided where another coaxial connector provides for an external load. Such a load connector is typically 43 applying to the meander line 18.

Figure 8:
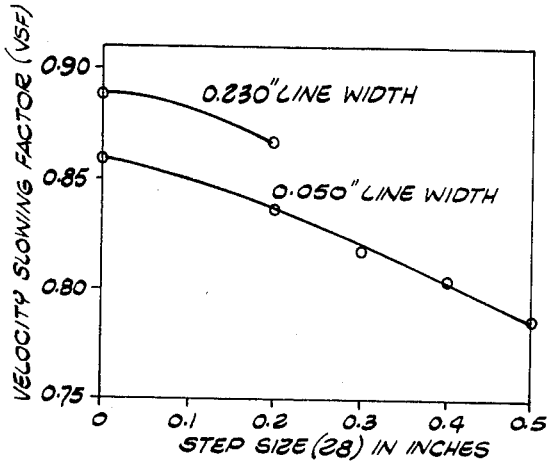
FIG. 8 is a plot of the velocity slowing factor as a function of step size for two line widths in a meander line array.
Figure 9:
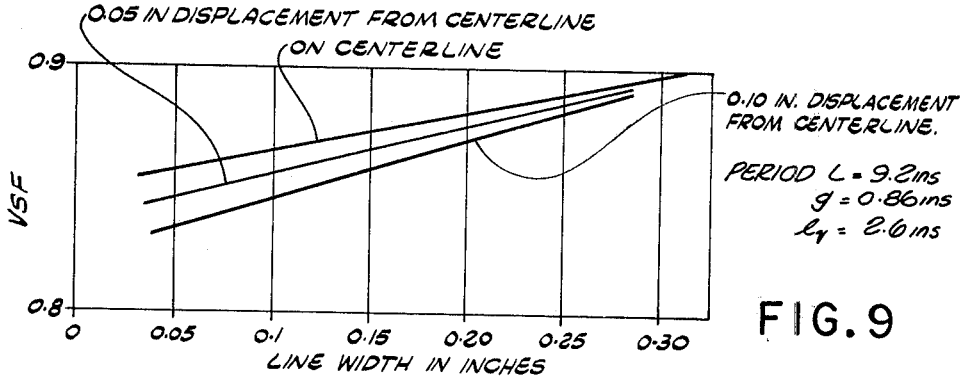
FIG. 9 is a plot of the velocity slowing factor as a function of line width for various step sizes for a meander line as employed in the invention.
Figure 10:
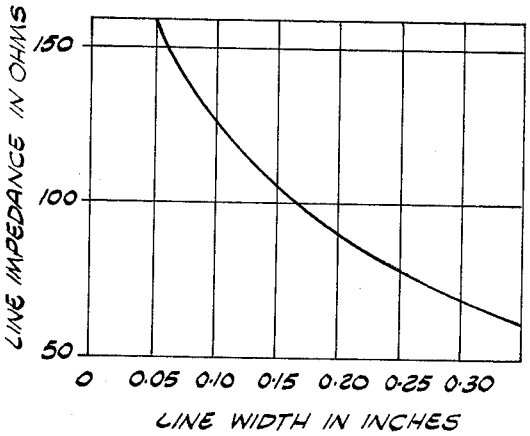
FIG. 10 depicts the calculated line impedance of a meander lines as a function of line width.

A typical integrated array essentially in accordance with FIG. 1 was 11 feet, 6 inches long and produced a radiation pattern in which the side lobes were on the order of -25dB. An inherent limitation in the achievement of good sidelobe performance is the phase errors that arise due to the variation in VSF (Velocity Slowing Factor) with line offset. The significance of this VSF factor is well understood by those of skill in this art. FIG. 8 plots that factor as a function of step size (2δ) for the typical design contemplated. Note that values for a significantly larger line width are also partially plotted in addition to the 0.050 more typical meander line width of the representative design. It is also known that the dielectric board upon which the meander line is placed is an important factor in respect to VSF. In general, the 1/16th inch dielectric board employed in the representative design is more substantial than necessary, and the use of a thinner material would alleviate the VSF problem. In the present design, phase error can be minimized by varying meander-line period according to the offset size along the length of the antenna. In order to obtain the degree of radiation coupling necessary, the amplitude of the periodic modulation (step size) along the meander line must vary up to as much as 0.4 inches. FIG. 9 depicts the VSF as a function of line width for various step sizes. From this, the design influence of these interrelated factors may be understood.

It can be shown that the beam angle for step sizes of 0.1 inches and 0.4 inches, each with an appropriate period chosen for zero phase error at 1.1 GHz, increases with frequency by as much as 30° ± between predetermined band-centers.

It can also be shown that there is an approximate linear relationship between meander line period in inches and step size (2δ) in inches. Table 1 gives the meander line design data for two percentages of power into the end load, namely, 25 and 30%. A typical interrelationship of meander line section length and step magnitude with the resultant radiation coupling in dB can be understood therefrom in respect to the typical design described.

Figure 6:
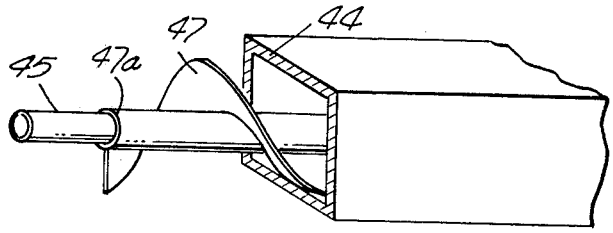
FIG. 6 is a detail showing a typical construction for the square coaxial transmission line implied in the configuration of FIGS. 3 and 4.

Referring now to FIG. 6, a typical construction for the slotted, coaxial line elements of the second subarray as depicted in FIG. 4. A helical extruded polyethylene helix insulator 47 molded or otherwise affixed to a polyethylene tube 47*a* which jackets the inner conductor 45 provides a typical low-loss, high-performance means of supporting the center conductor within the square coax outside conductor 44. For L-band, a typical inside dimension for the outer conductor 44 is 0.78 inches (square), while outside dimensions are 0.86 inches (square). Ordinary waveguide wall materials are satisfactory for the construction of FIG. 6, including aluminum for the outer conductor. The inner conductor 45 may be satisfactorily formed of a copper clad aluminum rod.

The design of the slotted coaxial elements according to FIG. 6, as also depicted in FIGS. 3 and 4, is less difficult where the band of interest is relatively narrow. In a typical array according to FIG. 3, the overall length is on the order of 6 feet and comprise 12 identical slots in each square coaxial transmission line employed. Although not illustrated, a slot angle up to 9° may be used in order to obtain maximum coupling. In that connection, it will be noted that the slots depicted in FIG. 3 are essentially horizontal or colinear, however, such a 9° inclination (alternately) of these slots may advantageously be employed.

From the general theory of square, coax, slotted-radiator linear arrays, increased band width can be realized by the use of slot pairs, however, it is believed that the most practical application of the configuration of FIG. 3 is in the environment of narrow band width of the second subarray in connection with which relatively high power operation can be employed.

TABLE I

MEANDER-LINE PARAMETERS FOR ZERO PHASE ERROR AT 1.1 GHz

| 25% Power in Load | | | | 30% Power in Load | | | |
|---|---|---|---|---|---|---|---|
| Element Number | Section Length (Inches) | Coupling (dB) | Step Size (2∂) (Inches) | Element Number | Section Length (Inches) | Coupling (dB) | Step Size (2∂) (Inches) |
| 1 | 4.725 | −22.3 | 0.100 | 1 | 4.720 | −22.7 | 0.105 |
| 2 | 4.715 | −22.0 | 0.110 | 2 | 4.715 | −22.4 | 0.110 |
| 3 | 4.705 | −21.3 | 0.120 | 3 | 4.710 | −21.7 | 0.115 |
| 4 | 4.690 | −20.2 | 0.140 | 4 | 4.695 | −20.6 | 0.135 |
| 5 | 4.675 | −19.1 | 0.160 | 5 | 4.680 | −19.4 | 0.155 |
| 6 | 4.660 | −17.8 | 0.180 | 6 | 4.655 | −18.2 | 0.185 |
| 7 | 4.635 | −16.7 | 0.210 | 7 | 4.645 | −17.1 | 0.200 |
| 8 | 4.610 | −15.6 | 0.240 | 8 | 4.620 | −16.0 | 0.230 |
| 9 | 4.585 | −14.7 | 0.265 | 9 | 4.595 | −15.1 | 0.255 |
| 10 | 4.555 | −13.8 | 0.300 | 10 | 4.570 | −14.2 | 0,280 |
| 11 | 4.535 | −13.1 | 0.320 | 11 | 4.545 | −13.5 | 0.305 |
| 12 | 4.515 | −12.5 | 0.340 | 12 | 4.530 | −12.9 | 0.325 |
| 13 | 4.490 | −12.0 | 0.360 | 13 | 4.515 | −12.4 | 0.340 |
| 14 | 4.470 | −11.5 | 0.380 | 14 | 4.490 | −12.0 | 0.360 |

TABLE I-continued

| MEANDER-LINE PARAMETERS FOR ZERO PHASE ERROR AT 1.1 GHz | | | | | | | |
|---|---|---|---|---|---|---|---|
| 25% Power in Load | | | | 30% Power in Load | | | |
| Element Number | Section Length (Inches) | Coupling (dB) | Step Size (2a) (Inches) | Element Number | Section Length (Inches) | Coupling (dB) | Step Size (2a) (Inches) |
| 15 | 4.460 | −11.2 | 0.390 | 15 | 4.480 | −11.7 | 0.370 |
| 16 | 4.455 | −11.0 | 0.400 | 16 | 4.475 | −11.6 | 0.375 |
| 17 | 4.445 | −10.8 | 0.410 | 17 | 4.470 | −11.5 | 0.380 |
| 18 | 4.445 | −10.8 | 0.410 | 18 | 4.470 | −11.5 | 0.380 |
| 19 | 4.455 | −11.0 | 0.400 | 19 | 4.480 | −11.7 | 0.370 |
| 20 | 4.460 | −11.3 | 0.390 | 20 | 4.490 | −12.0 | 0.360 |
| 21 | 4.480 | −11.7 | 0.370 | 21 | 4.515 | −12.5 | 0.340 |
| 22 | 4.505 | −12.3 | 0.350 | 22 | 4.535 | −13.2 | 0.320 |
| 23 | 4.535 | −13.1 | 0.320 | 23 | 4.570 | −14.1 | 0.280 |
| 24 | 4.570 | −14.0 | 0.280 | 24 | 4.590 | −15.0 | 0.260 |
| 25 | 4.590 | −14.9 | 0.260 | 25 | 4.620 | −15.9 | 0.230 |
| 26 | 4.610 | −15.7 | 0.240 | 26 | 4.640 | −16.8 | 0.205 |
| 27 | 4.625 | −16.3 | 0.220 | 27 | 4.645 | −17.4 | 0.195 |
| 28 | 4.635 | −16.4 | 0.210 | 28 | 4.650 | −17.5 | 0.190 |

Figure 11:
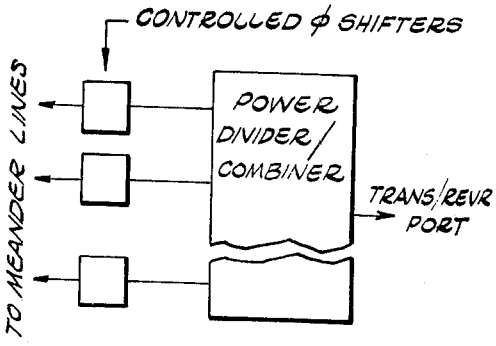
FIG. 11 depicts a typical meander-line feed arrangement.

The meander line design integrated with the slotted waveguide first subarray, according to FIG. 1, provides for substantially greater bandwidth of operation than has been shown to be a satisfactory arrangement for achieving the objective of the invention which was the integration of first and second subarrays at essentially a common phase center for separate and independent operation and feed. The individual linear meander line arrays of FIG. 1 might appropriately be fed at their drive coaxial connector ends (typically 41) from a power divider/combiner (having as many ports as meander line linear arrays are employed in the second subarray). Still further, each lead from this power divider/combiner can include a controlled phase shifter between each power divider/combiner port and the corresponding meander line, see FIG. 11. In that way, phase scanning in essentially the same plane as scanned by the slotted-waveguide first subarray may be effected. The slotted-waveguide first subarray basically provides horizontal polarization whereas the meander line second subarray provides vertical polarization. The alternative second subarray employing the configuration of FIG. 3 likewise produces vertical polarization.

In accordance with this description, the integrated array invention herein described will be understood to provide a structure facilitating the substantially independent scanning and frequency band of operation for each of the two subarrays included substantially at the common phase center of the two.

Modifications and variations will be understood to be possible, some of these being suggested in the foregoing description. Accordingly, it is not intended that the drawings of this description should be considered as defining the limits of the scope of the present invention, those being intended to be typical and illustrative only.

What is claimed is:

1. An integrated multi-band antenna array comprising:

a first two-dimensional subarray comprising a plurality of first linear rectangular waveguide arrays each having a plurality of narrow wall slot radiators, said linear waveguide arrays being spaced between facing broad walls of adjacent ones of said linear waveguide arrays thereby generating a plurality of intervening spaces;

means defining a conductive walled continuous enclosure open substantially only toward the aperture of said array, within each of said intervening spaces;

a second two-dimensional subarray comprising a second plurality of linear arrays, each within a corresponding one of said intervening spaces, the number of said second linear arrays being not greater than the number of said first linear arrays and said second linear arrays being of a type selected from a group comprising meander lines and square, coaxial line, longitudinally-slotted linear arrays;

and first and second feed arrangements for independently feeding said first and second subarrays, respectively, according to separate corresponding excitation programs.

2. A system according to claim 1 in which said linear arrays of said second subarray are meander lines.

3. A system according to claim 1 in which said linear arrays of said second subarray are square coaxial lines longitudinally slotted linear arrays.

4. Apparatus according to caim 2 in which said meander lines are each formed as printed circuit elements on a dielectric sheet within each of said intervening spaces and generally parallel to the plane of the aperture of said integrated array.

5. Apparatus according to claim 4 in which said meander lines are each located within a corresponding intervening space substantially one quarter wavelength from the back conductive surface of the corresponding intervening space.

* * * * *